US005378124A

United States Patent [19]

Welch

[11] Patent Number: 5,378,124

[45] Date of Patent: Jan. 3, 1995

[54] METHOD AND MEANS FOR ASSEMBLING A PUMP AND MOTOR

[75] Inventor: Rodney M. Welch, Newton, Iowa

[73] Assignee: Maytag Corporation, Newton, Iowa

[21] Appl. No.: 55,114

[22] Filed: Jun. 7, 1993

[51] Int. Cl.[6] ..... F04B 17/00

[52] U.S. Cl. ..... 417/423.1; 416/224; 134/57 D

[58] Field of Search ..... 417/423.1, 423.15, 423.14; 416/224 R; 134/56 D, 57 D, 58 D

[56] References Cited

U.S. PATENT DOCUMENTS

| | | | |
|---|---|---|---|
| 3,614,261 | 10/1971 | Friese | 416/244 |
| 4,130,374 | 12/1978 | Bingler | 417/423.1 |
| 4,168,715 | 9/1979 | Spiegel et al. | 134/104 |
| 4,746,269 | 5/1988 | Raab | 415/170 A |
| 4,799,855 | 1/1989 | Milocco et al. | 415/143 |
| 4,822,241 | 4/1989 | Jarvis et al. | 415/132 |
| 4,944,653 | 7/1990 | Wilkes | 415/174 |

*Primary Examiner*—Richard A. Bertsch
*Assistant Examiner*—Alfred Basichas
*Attorney, Agent, or Firm*—Zarley, McKee, Thomte, Voorhees, & Sease

[57] ABSTRACT

A pump assembly includes a motor having a rotatable motor shaft, and a pump housing having a housing wall with an exterior side and an interior side. Within the pump housing is an impeller which is mounted on the shaft for rotation in unison therewith, and which is free to slide axially along the shaft. A first coupler is rotatably mounted on the shaft outside the housing wall and a second coupler is attached to the impeller. The first and second couplers are retentively and movably engaged and are adapted to cooperate with one another so that they will cause the impeller to move axially on the shaft to a desired position.

19 Claims, 6 Drawing Sheets 18
24
73
102
68
35
40
44

70
66
64
76
68
73
72
74
102
78
80
88
82
86
84
90
18
24
36
35
34
60
62
46
50
48
52
52
44
40
42

METHOD AND MEANS FOR ASSEMBLING A PUMP AND MOTOR

BACKGROUND 0F THE INVENTION

The present invention relates to a method and means for assembling a pump and motor, and particularly to a method and means for assembling a pump and motor for a dishwasher.

Present dishwashers include a pump which is adapted to receive washing fluid at the bottom of the dishwasher tub and to recirculate that washing fluid through spray arms within the tub. Prior art pumps include a pump housing having a rotatable impeller mounted therein. A motor is rigidly secured to the exterior of the housing and includes a motor shaft which extends into the housing where it is attached to the impeller for driving the impeller.

It is important that the axial position of the impeller on the motor shaft be precisely oriented so as to permit proper sealing of the motor shaft and the impeller.

Therefore a primary object of the present invention is the provision of an improved method and means for assembling a pump and motor.

A further object of the present invention is the provision of an improved method and means for assembling a pump and motor wherein the impeller is attached to the motor shaft in the proper desired axial position on the shaft.

A further object of the present invention is the provision of a method and means for assembling a pump and motor which permits the assembling and disassembling of the impeller from the motor shaft without the necessity of opening the pump housing.

A further object of the present invention is the provision of a method and means for assembling a pump and motor which causes the impeller to be properly positioned within the pump housing and to be properly registered with the motor shaft during assembly.

A further object of the present invention is the provision of an improved method and means for assembling a pump and motor, which first locates the impeller in the proper position to locate the motor during assembly, and which provides a proper clearance between the impeller and the shaft opening in the pump housing after assembly is complete.

A further object of the present invention is the provision of an improved method and means for assembling a pump and motor which is efficient in operation, simple in construction, and durable in use.

SUMMARY OF THE INVENTION

The foregoing objects are achieved by a method and means for assembling a pump and motor wherein the motor is secured to the exterior of the pump housing with the motor shaft extending through a shaft opening in the pump housing. In one embodiment of the invention, a first coupling means is rotatably mounted on the motor shaft on the exterior side of the housing wall. This first coupling means can be a fan blade for the motor during operation. The fan blade initially is free to rotate on the motor shaft prior to assembly.

A stop means is provided on the motor shaft for limiting the axial movement of the first coupling means or motor fan toward the pump housing.

An impeller is mounted within the pump on the interior side of the pump housing wall and is fitted over splines on the end of the motor shaft so that the impeller will rotate in unison with the shaft, but so that the impeller is free to slide axially along the length of the shaft. A second coupling means is attached to or made an integral part of the impeller and includes threads which are adapted to threadably engage mating threads of the first coupling means on the motor fan.

The stop means on the motor shaft for limiting axial movement of the first coupling means toward the pump housing comprises a circumferential groove having a stop member mounted therein. The fan blade engages the stop member and is held against further axial movement toward the pump housing.

The impeller is assembled to the motor by first fitting the second coupling means of the impeller over the splined motor shaft and then threadably engaging the second coupling means with the first coupling means so as to draw the impeller axially toward the motor fan and coupling means. The second coupling means is drawn toward the first coupling means until the stop member is tightly fitted therebetween. The stop member in this position provides precise axial positioning of the impeller on the motor shaft.

A sealing member is provided within the pump housing and is positioned between the impeller and the interior wall of the pump housing. When the impeller is fully assembled the sealing member is compressed between the interior wall of the housing and the impeller so as to provide a fluid seal therebetween.

The motor can be detached from the pump quite easily, merely by rotating the fan blade in a direction which causes the first and second coupling means to threadably disengage. It is then possible to detach the motor from the pump housing and slidably remove the motor shaft from the impeller. Reassembly is merely a reverse process, namely inserting the motor shaft into the impeller, reattaching the motor to the pump housing and rotating the fan blade until the first and second coupling means are threadably engaged together in their fully assembled position.

BRIEF DESCRIPTION 0F FIGURES OF THE DRAWINGS

DESCRIPTION OF THE PREFERRED EMBODIMENT

Figure 1:
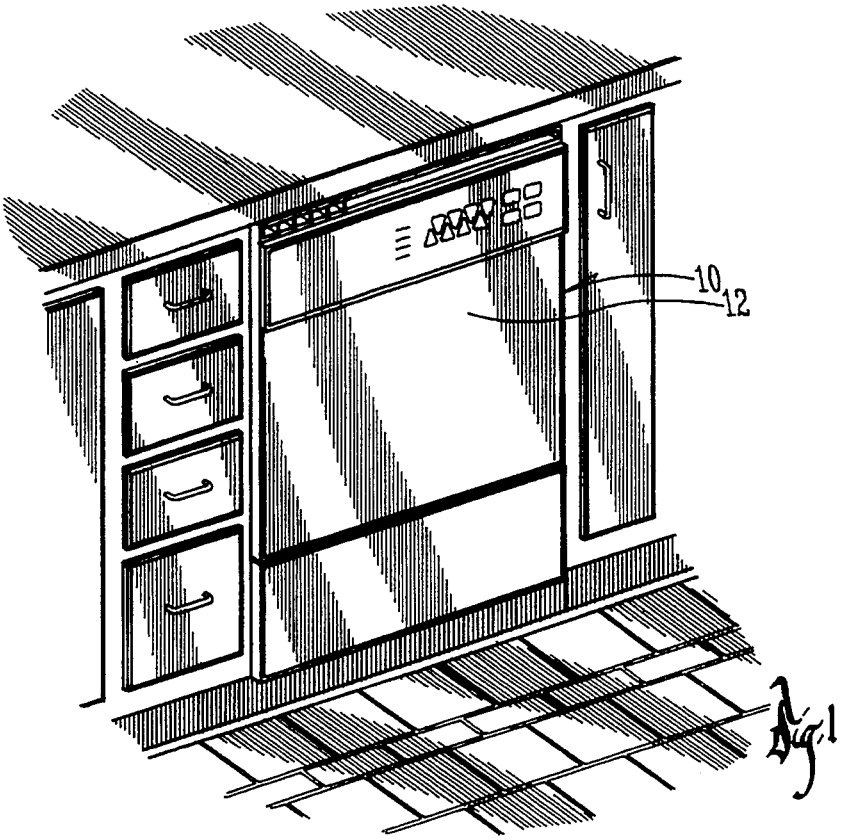
FIG. 1 is a perspective view of a dishwasher.
Figure 2:
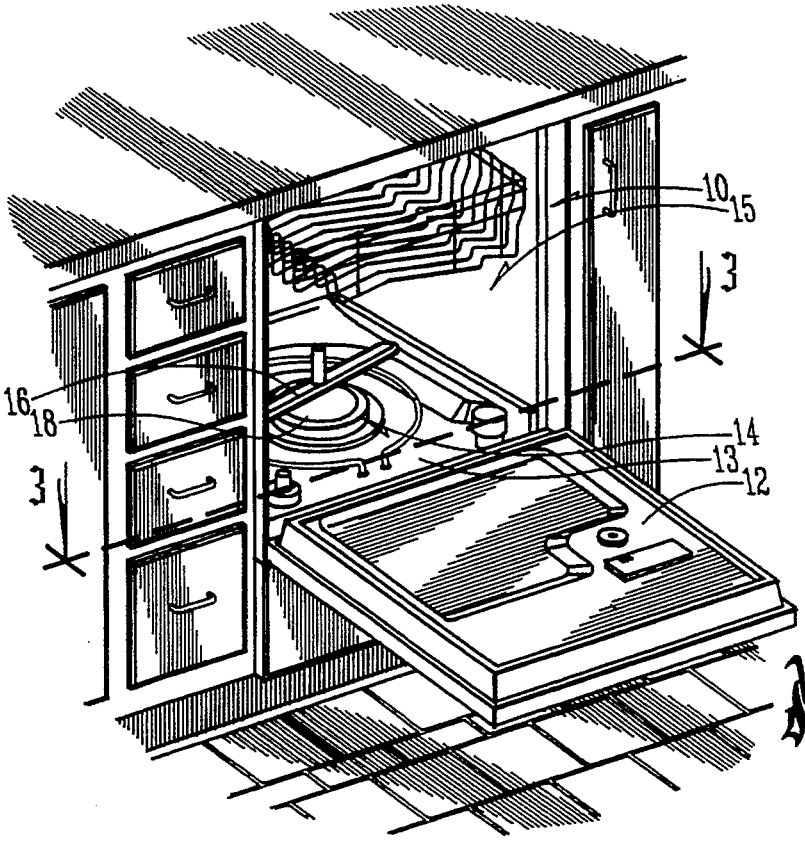
FIG. 2 is a view similar to FIG. 1 showing the inside of the dishwasher.
Figure 3:
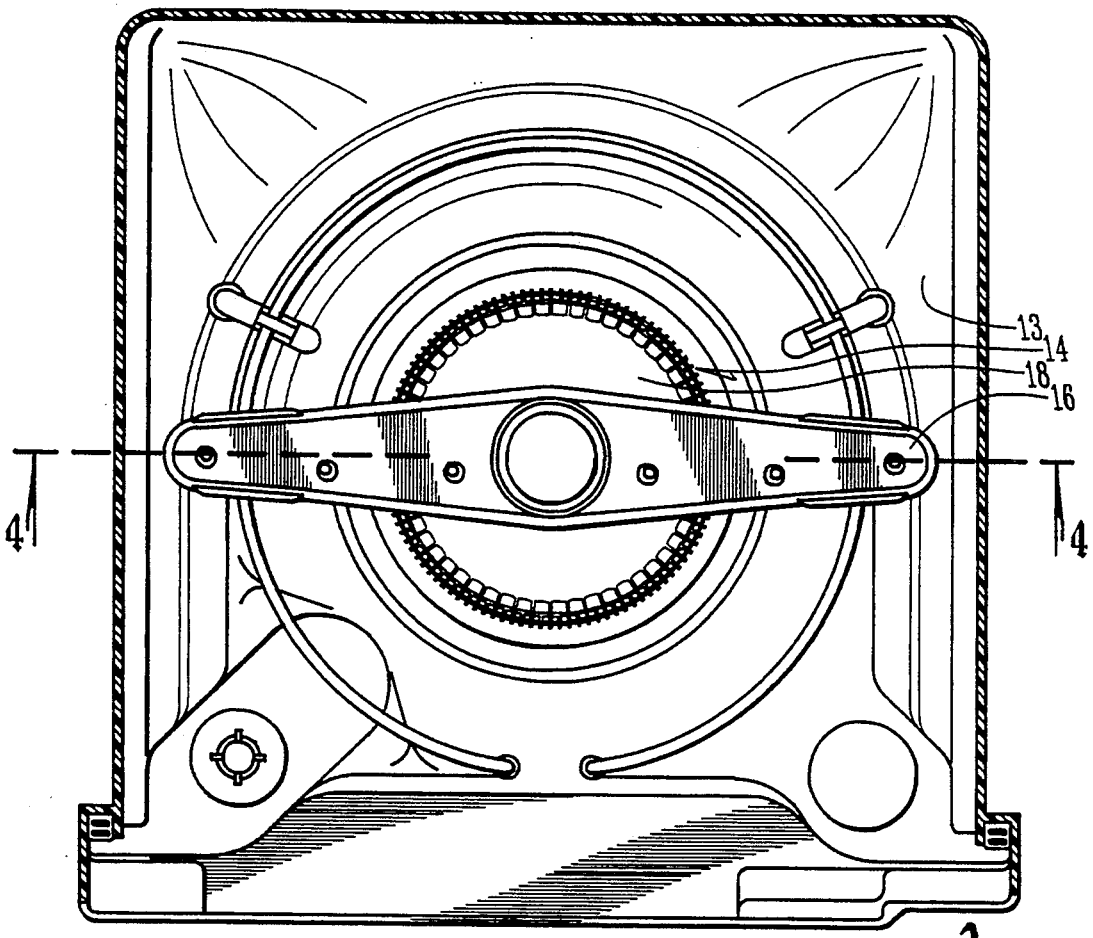
FIG. 3 is a top sectional view taken along line 3—3 of FIG. 2.

Referring to the drawings numeral 10 generally designates a dishwasher having a door 12 which opens into a washing compartment or chamber 15 having a bottom wall 13. Within the compartment 15 is a spray arm 16 which is adapted to rotate and spray washing fluid within the compartment 15.

Figure 4:
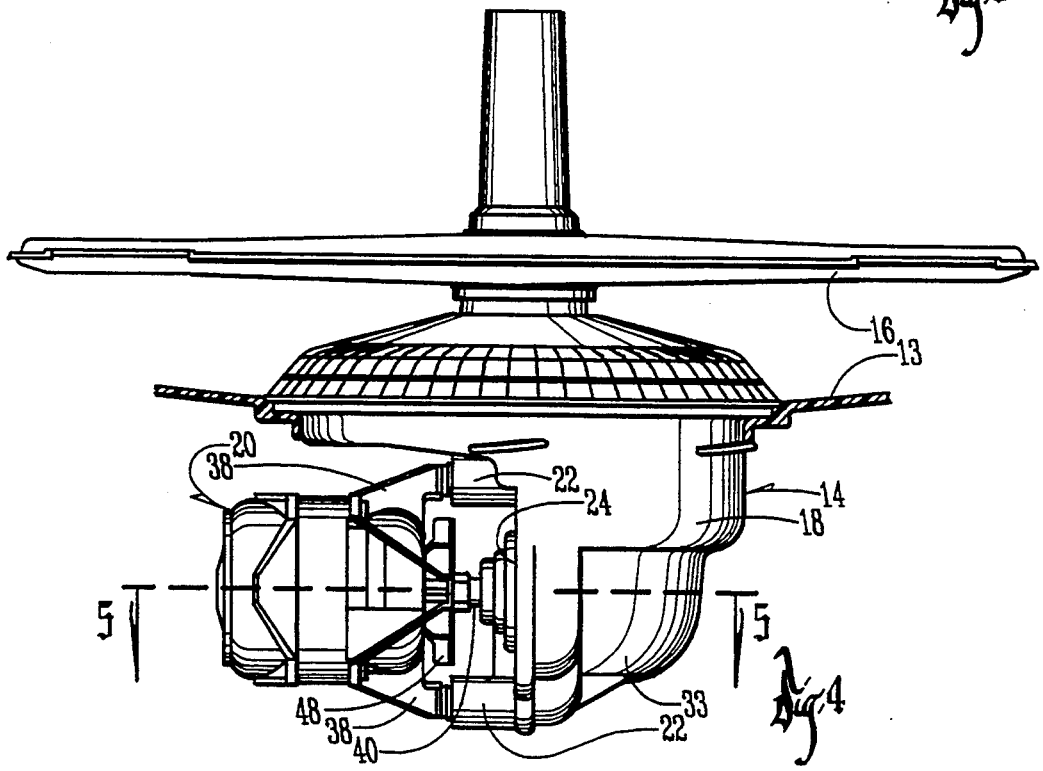
FIG. 4 is a sectional view taken along line 4—4 of FIG. 3.

Located beneath bottom wall 13 is a pump 14 (FIG. 4) comprised of a pump housing 18 and a motor 20.

Figure 5:
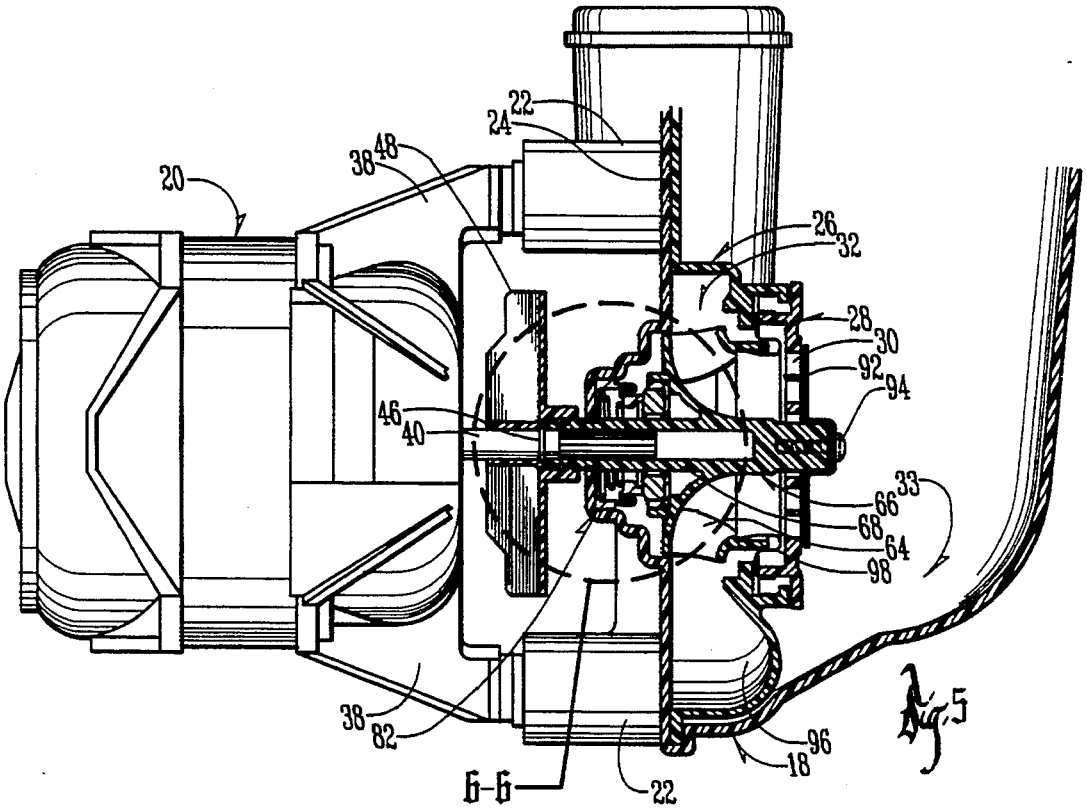
FIG. 5 is a sectional view taken along line 5—5 of FIG. 4.
Figure 6:
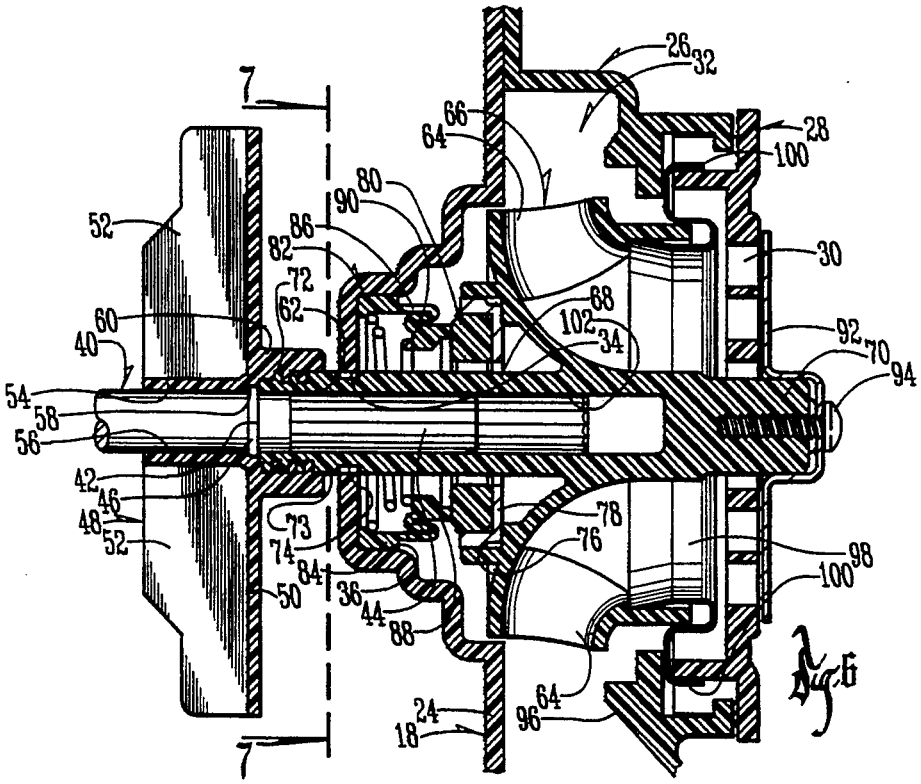
FIG. 6 is an enlarged sectional view taken along line 6—6 of FIG. 5.
Figure 9:
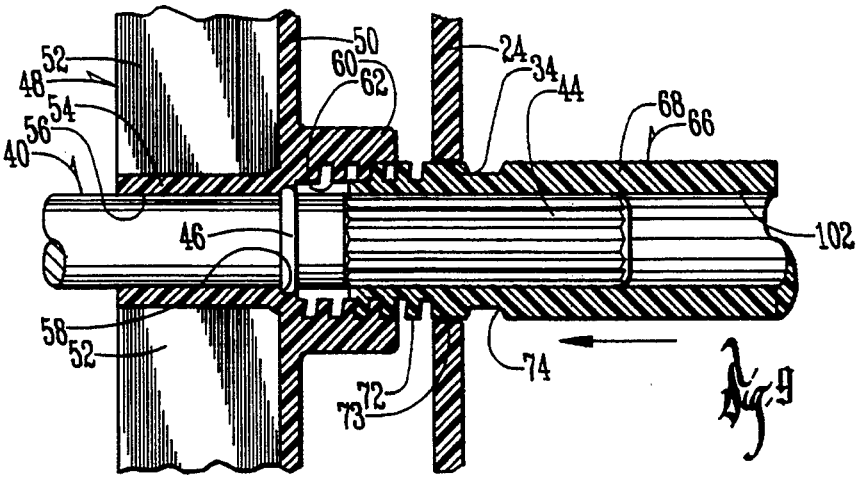
FIG. 9 is an enlarged sectional detail view similar to FIG. 6 but showing the impeller and the motor in a partially assembled condition.

Referring to FIGS. 5, 6, and 9, pump housing 18 includes at least one mounting receptacle 22 for mounting the motor 20 to the pump housing 18. Pump housing 18 includes a front wall 24 which is generally circular and which is joined with a impeller housing or volute 26 and an inlet grid 28 for forming an impeller chamber 32. Inlet grid 28 is detachably secured to the impeller housing 26 by locking tabs, threads or the like in conventional fashion, and includes a plurality of grid openings 30 therein providing communication from within impeller chamber 32 to a return chamber 33 (FIG. 5) through which fluid is returned from the washing chamber 15 in dishwasher 10. Fluid is permitted to return through return chamber 33 and the grid openings 30 into the impeller chamber 32.

Figures 7, 8:
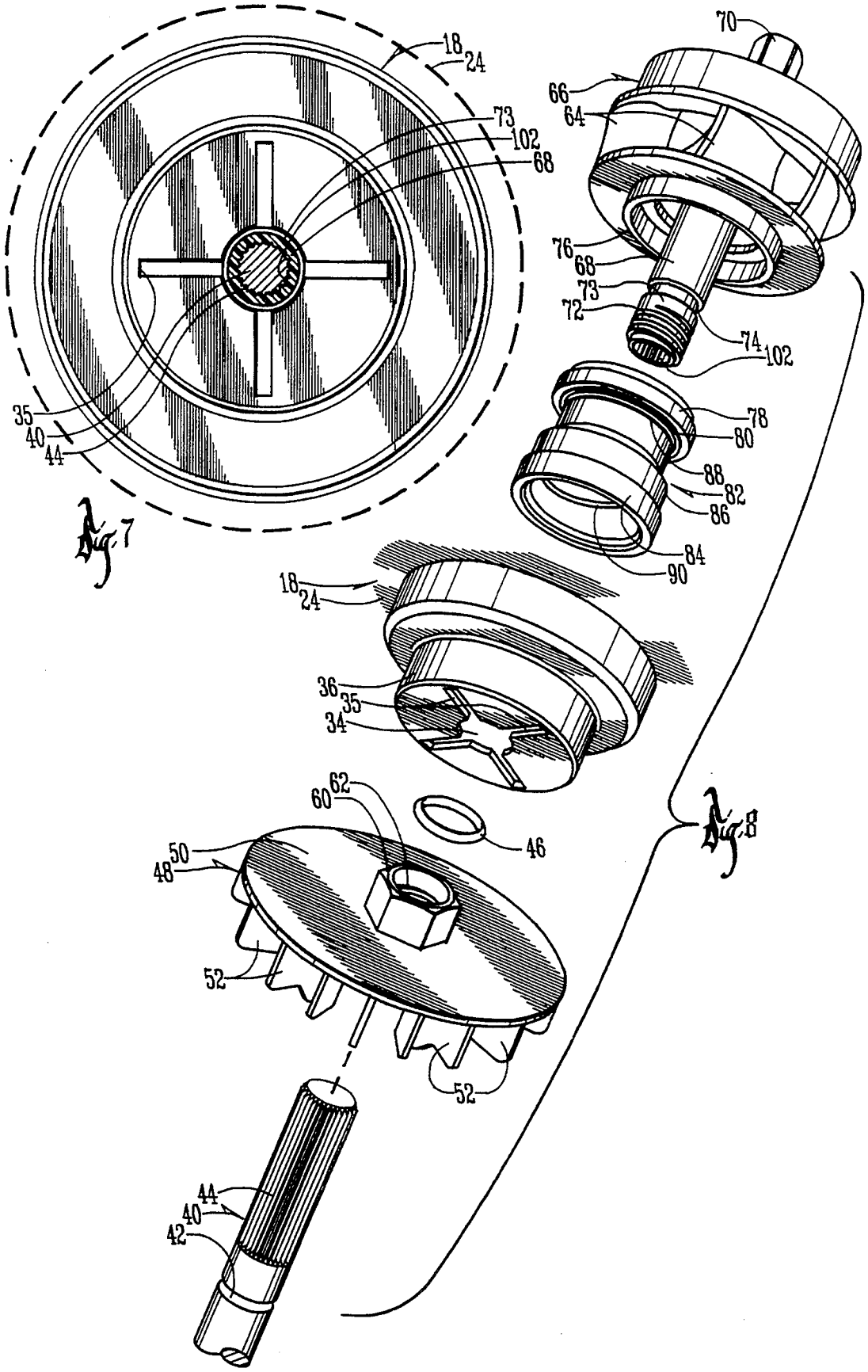
FIG. 7 is a sectional view taken along line 7—7 of FIG. 6.
FIG. 8 is an exploded perspective view of the motor shaft and the various components mounted thereon.

Front wall 24 of pump housing 18 includes a shaft opening 34 therein (FIG. 8) which has a plurality of slots 35 extending radially outwardly therefrom and which allow inspection of the sealing member 82. The front wall 24 is shaped to provide an annular recess 36 (FIG. 6) inside the front end of impeller chamber 32.

Motor 20 includes four mounting legs 38 which are registered with mounting receptacles 22 and are attached thereto by screws or the like. Motor 20 includes a motor shaft 40 having an annular groove 42 therein and having a splined end 44. Although splines are shown for providing a driving connection between the motor shaft 40 and the impeller 66, it is anticipated that mating flats or other connecting means could be readily substituted.

A fan 48 is slipped over motor shaft 40 and is positioned outside the impeller chamber 32 in front of front wall 24. Fan 48 is comprised of a circular plate 50, a plurality of fan blades 52, and an outer sleeve 54 having an outer bore 56 which slideably fits over motor shaft 40. At the inner end of outer bore 56 is counter bore 58 which is positioned between the outer bore 56 and an inner threaded bore 62 which is within an inner sleeve 60. As can best be seen in FIG. 9 stop ring 46 formed from plastic, metal or other generally rigid material is fitted within the annular groove 42 of motor shaft 40 and fits also within the counter bore 58 of fan 48 so as to limit axial sliding movement of fan 48 toward the front wall 24.

Within impeller chamber 32 is an impeller 66 having an outer tube 68 extending axially through shaft opening 34 in front wall 24. Impeller 66 includes a plurality of impeller blades 64 thereon for forcing washing fluid outwardly through a recirculation conduit 96 (FIG. 5). Extending in the opposite axial direction from impeller 66 is an inner hex shaft 70.

The outside surface of outer tube 68 includes exterior threads 72. A pilot surface 73 is located at the inner end of the threads 72, and a clearance groove 74 is located inwardly of the pilot surface 73. The pilot surface 73 is circular, and is adapted to fit in close proximity to shaft opening 34 during assembly of the motor 20 to the pump housing 18. The clearance groove 74 is of reduced diameter, and when registered with the shaft opening 34 provides a clearance space therebetween after assembly of the motor 20 to the pump housing 18.

Extending axially forwardly from the impeller 66 is an annular seal flange 76. As can be seen in FIG. 6, a circular seal seat 78 and a circular ceramic seal ring 80 are press fitted within the seal flange 76.

A sealing member 82 (FIG. 8) surrounds the outer tube 68 of impeller 66, when assembled and includes an outer rim 84 which is press fitted within the annular recess 36 in front wall 24. An inner carbon seal ring 88 frictionally bears against the bearing surface provided by ceramic sealing ring 80. Extending between outer rim 84 and inner carbon seal ring 88 is a flexible bellows or boot 86 which contains a coil spring 90 yieldably urging the outer rim 84 and the inner carbon seal ring 88 away from one another and biasing seal ring 88 toward ceramic ring 80. It is possible that the seal seat 78 and seal ring 80 could be mounted within recess 32 of the pump housing 18 and the sealing member 82 could be mounted within the flange 76 or the impeller 66 to produce similar sealing results.

A cutting blade 92 is fitted over the inner hex shaft 70 of impeller 66 outside of the inlet grid 28 and is held in place by means of a screw 94.

A wear ring 98 is fitted between impeller 66 and inlet grid 28. Wear ring 98 includes tabs 100 which fit within slots in the inlet grid 28 so as to prevent rotation of wear ring 98 with respect to inlet grid 28.

The assembly of the device is as follows. A subassembly comprising the impeller 66 with seal seat 78 and seal ring 80, wear ring 98, inlet grid 28 and cutting blade 92 and screw 94 are inserted into the impeller chamber 32. The sealing member 82 has been previously press fitted into the annular recess 36 and the outer tube 68 of the impeller 66 passes through the bore of the sealing member 82. In this position, the outer tube 68 of impeller 66 is positioned as shown in FIG. 9, with the pilot surface 73 registered axially with the shaft opening 34 of front wall 24. The clearance groove 74 is positioned axially inwardly from the shaft opening 34. The spring 90 within sealing member 82 yieldably holds the tube 68 in this axial position shown in FIG. 9. After the subassembly including impeller 66 has been fitted within impeller chamber 32, the inlet grid 28 is rotated through a partial turn to lock the subassembly to the pump housing 28.

In this position the pilot surface 73 properly centers the outer tube 68 of impeller 66 within the shaft opening 34 of front wall 24 in the manner shown in FIG. 9. The motor 20 is then placed in position so that the motor shaft 40 is inserted within the hollow bore 102 of outer tube 68 of impeller 66. Hollow bore 102 includes splines therein which engage the splined end 44 of motor shaft 40 and prevent rotation therebetween. However, the hollow bore 102 and the splined end 44 of motor shaft 40 are free to slide axially with respect to one another.

Next the motor 20 is secured in place by means of bolts or other securing means which attach the motor mounting legs 38 of motor 20 to the mounting receptacles 22 of pump housing 18.

The final step of assembly in this preferred embodiment is to rotate the fan 48 so that the threaded bore 62 of fan 48 threadably engages the exterior threads 72 on the outer tube 68 of impeller 66. These threads draw the fan 48 and the impeller 66 toward one another in response to movement therebetween. During the rotation of fan 48, shaft 40 should be held against rotation by conventional lock means provided on motor 20, or by placing a finger on the armature of motor 20 to prevent rotation of the armature. Alternatively, the fan 48 can be held stationary and the impeller 66 rotated by means of a right angle driver on the hex portion of cutter blade 92.

The continued rotation of fan 48 causes the impeller 66 to be drawn outwardly in an axial direction toward the motor 20 from the position in FIG. 9 to the position in FIGS. 5 and 6. In its final operable position, the end of outer tube 68 engages the stop ring 46. Also, the clearance groove 74 on outer tube 68 moves from the position shown in FIG. 9 to the position in FIG. 6 wherein it is registered with the shaft opening 34. This provides a clearance space during rotation of the impeller 66. In the final operable position with impeller 66 held axially against stop ring 46, compressive force is applied to the coil spring 90 of sealing member 82 to provide sealing without the need for thrust bearings in the pump assembly.

The motor 20 can be easily removed without disassembling the pump housing 18 merely by rotating the fan 48 in an opposite direction to cause unthreading of the exterior threads 72 on outer tube 68 and the interior threads on the threaded bore 62 of fan 48.

The outer tube 68 of impeller 66 and the threaded bore 62 of inner sleeve 60 on fan 48 provide coupling means which couple the impeller 66 to the motor shaft 40. The stop ring counter bore 58 of fan 48 engages the stop ring 46 and prevents axial sliding movement of the fan towards the front wall 24 of the pump housing 18. Thus when the fan 48 is threaded to the outer tube 68 of impeller 66, it is the impeller which moves axially while the fan remains stationary.

Figure 10:
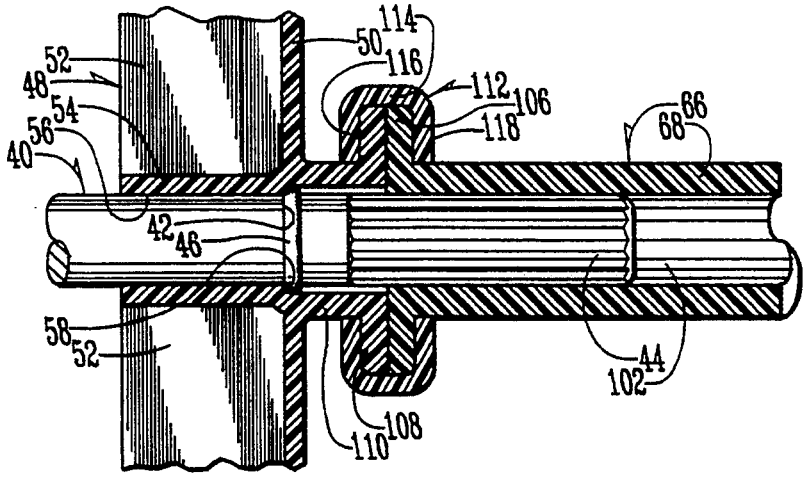
FIG. 10 is a detail sectional view of a modified form of the invention.
Figure 10A:
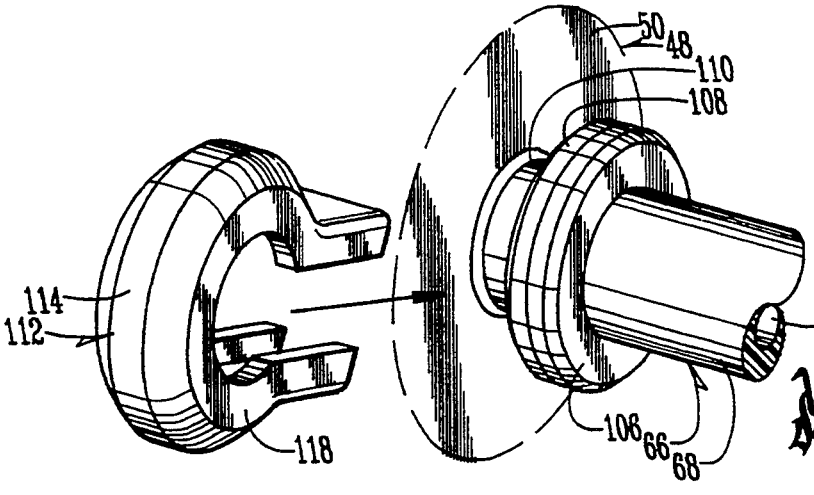
FIG. 10A is an exploded pictorial view of the modification in FIG. 10.

FIGS. 10, 10A, 11, 11A and 12, 12A show three modified embodiments for axially locating the impeller 66 and fan 48 on the motor shaft 50. FIGS. 10, 10A, show a modified embodiment 104. In this modified embodiment the outer tube 68 of impeller 66 is provided with an annular flange 106, and a second annular flange 108 is provided on a shank 110 of the fan 48. These annular flanges 106, 108 are in facing engagement and are locked together by means of a plastic clip 112. Clip 112 in cross section includes a web 114 and a pair of spaced apart flanges 116, 118 which are adapted to embrace the flanges 106, 108 therebetween and hold the flanges against axial movement away from one another. The clip also prevents the flanges 106, 108 from rotating with respect to one another, and serrations (not shown) can be provided on the surfaces of these flanges to further cause them to be locked together. The axial positioning of the impeller 66 and the fan 48 on the shaft 40 is accomplished by means of the engagement of stop-ring 46 between the annular groove 42 on shaft 40 and the stop-ring counter bore 58 within outer sleeve 54 of fan 48.

Figure 11:
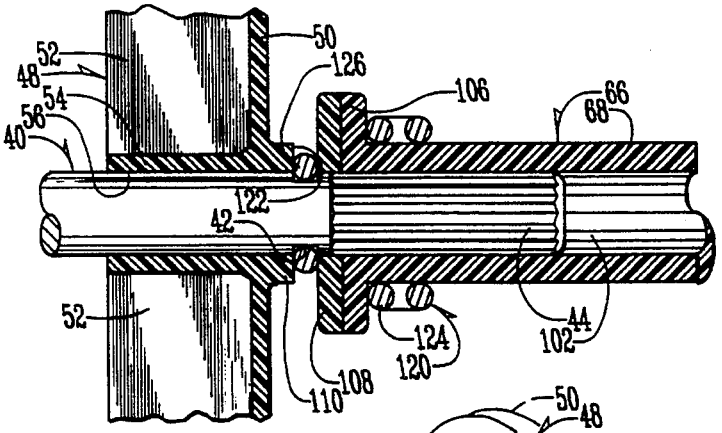
FIG. 11 is a detail sectional view of a further modified form of the invention.
Figure 11A:
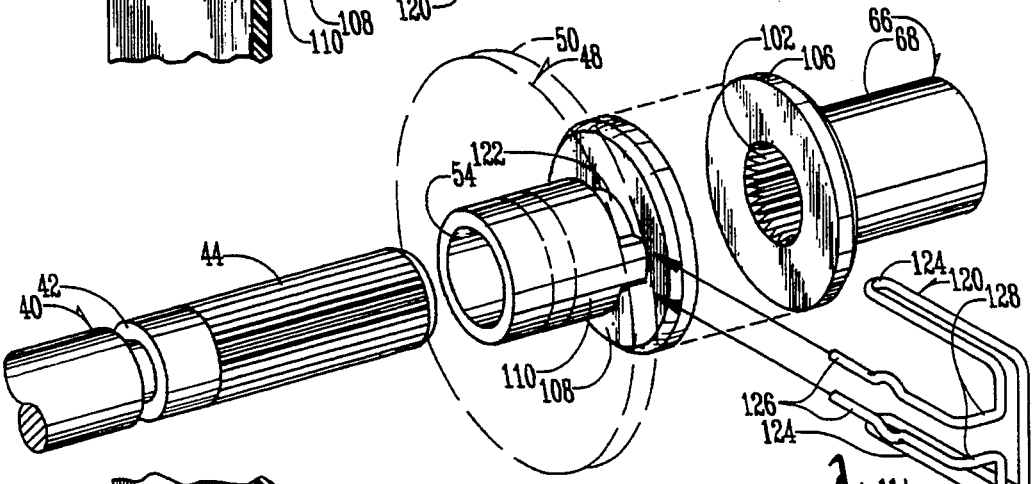
FIG. 11A is an exploded pictorial view of the modification in FIG. 11.

Referring to FIGS. 11, 11A, similar flanges 106, 108 are employed, but the shank 110 of fan 48 is provided with a groove or slot 122 which is adapted to receive a wire clip 120. Wire clip 120 includes a first pair of retaining fingers 124 and a second spaced apart pair of retaining fingers 126 which are interconnected by connecting members 128. Fingers 124 are adapted to engage flange 106 and fingers 126 are adapted to engage flange 108 to hold the two flanges 106, 108 together. In addition, one of the pairs of fingers 126 is adapted to fit within slot 122 and engage the annular groove 42 of shaft 40 so as to provide axial positioning of the fan 48 and the impeller 66 with respect to the shaft 40. In the modification shown in FIGS. 11, 11A, the annular groove 42 has been moved from the position shown in earlier embodiments so as to provide the proper positioning axially with respect to shaft 40.

Figure 12:
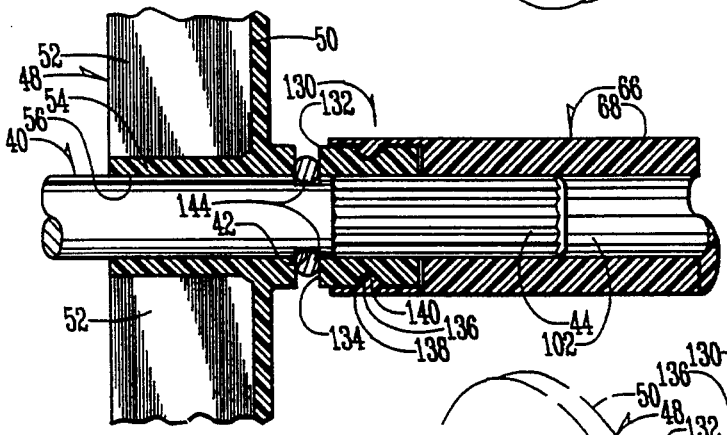
FIG. 12 is a detail sectional view of a further modified form of the invention.
Figure 12A:
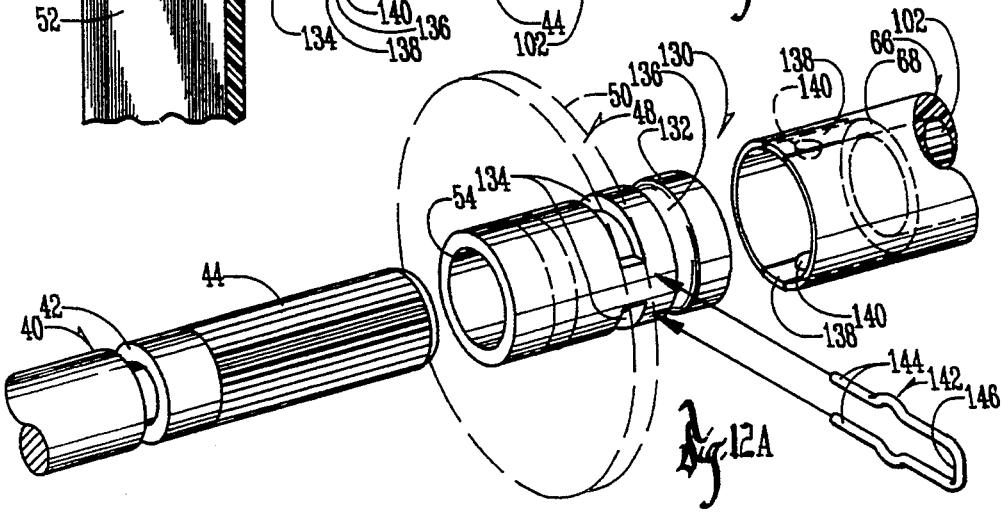
FIG. 12A is an exploded pictorial view of the modification in FIG. 12.

FIGS. 12, 12A, show a third modified form of the invention designated by the numeral 130. In this modification the fan 48 is provided with a fan shank tube 132 having an arcuate slot 134 therein. Also adjacent the outer end of shank tube 132 is an annular locking groove 136. Impeller 66 is provided with a pair of spring fingers 138 at its outer end, and each of these spring fingers 138 includes a locking node 140 which fits within the locking annular groove 136 of fan shank 132. A u-shaped spring 142 includes a pair of spaced apart fingers 144 interconnected by a connecting member 146. One of the spring fingers 144 fits within each arcuate slot 134 and also engages the annular groove 42 in shaft 40 so as to position the fan 48 and the impeller 66 so as to position them in the desired axial position on shaft 40.

In the specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

I claim:

1. An improvement in a pump assembly including a motor with a rotatable motor shaft, a pump housing wall having an exterior side, an interior side and a shaft opening extending therethrough, said motor being fixedly attached to said exterior side of said pump housing wall with said motor shaft extending through said shaft opening to said interior side of said housing wall, said improvement comprising:

first coupling means mounted on said motor shaft on said exterior side of said housing wall;

impeller means mounted on said shaft on said interior side of said housing wall, said impeller means being axially slideable on said shaft;

second coupling means fixedly attached to said impeller means and having an annular clearance groove therein;

said first and second coupling means retentively and movably engaging one another whereby relative rotation therebetween will cause said impeller means to move axially on said shaft from a first position wherein said annular clearance groove is spaced axially from said shaft opening to a second position wherein said annular clearance groove is registered within said shaft opening.

2. A pump assembly comprising:

a motor having a rotatable motor shaft extending therefrom;

a pump housing having a housing wall with an exterior side, an interior side and a shaft opening extending therethrough;

mounting means mounting said motor in fixed relation to said housing on said exterior side of said wall with said shaft extending through said shaft opening in said housing wall to said interior side of said housing wall;

first coupling means mounted on said shaft on said exterior side of said housing wall;

impeller means mounted on said shaft on said interior side of said housing wall, said impeller means being axially slideable on said shaft;

second coupling means fixedly attached to said impeller means;

said first and second coupling means retentively and movably engaging one another and being adapted to cooperate with one another whereby relative motion therebetween will cause said impeller means to move axially on said shaft;

said second coupling means having a pilot portion with an outer diameter closely approximating the shape and size of said shaft opening, said second coupling means having an annular clearance groove therein having a groove diameter less than said outer diameter of said pilot portion;

said second coupling means moving axially on said shaft in response to relative motion between said first and second coupling means from a first position wherein said pilot portion is registered axially within said shaft opening to a second position wherein said clearance groove is registered within said shaft opening.

3. A pump assembly according to claims 1 or 2 wherein said first coupling means is rotatably mounted on said shaft and said impeller means is mounted for rotation with said shaft.

4. A pump assembly according to claims 1 or 2 wherein said first and second coupling means retentively and rotatably engage one another and are adapted to cooperate with one another in response to relative rotation therebetween for causing axial movement of said impeller means on said shaft.

5. A pump assembly according to claim 4 wherein said first and second coupling means threadably engage one another.

6. A pump assembly according to claims 1 or 2 wherein stop means engage said first coupling means and limit axial movement of said first coupling means on said shaft toward said impeller means.

7. A pump assembly according to claim 6 wherein said stop means comprises a stop ring mounted on said shaft.

8. A pump assembly according to claim 7 wherein said first and second coupling means are movable relative to one another to a position wherein said stop ring engages both of said first and second coupling means.

9. A pump assembly according to claim 7 and further comprising sealing means providing a fluid seal between said impeller means and said interior side of said housing wall.

10. A pump assembly according to claim 9 wherein said sealing means includes a first portion associated with said impeller means, a second portion associated with said pump housing and biasing means in one of said first or second portions for biasing that portion toward the other portion wherein axial movement of said impeller means on said shaft toward said stop means increases the biasing force between said first and second seal means.

11. A pump assembly according to claim 2 and further comprising stop means including a circumferential groove on said shaft and a stop ring fitted within said groove.

12. A pump assembly comprising:

a pump housing having a housing wall with an exterior side, an interior side, and a shaft opening extending therethrough;

an impeller on said interior side of said housing wall;

an impeller tube affixed to said impeller and extending through said shaft opening to terminate in an open hollow tube end on said exterior side of said housing wall;

a coupler on said exterior side of said housing wall and having a bore extending therethrough;

a motor attached to said housing wall on said exterior side thereof and having a motor shaft extending first through said bore of said coupler and then telescopically into said open hollow tube end of said impeller tube, said motor shaft being free to slide axially within said hollow tube end while at the same time engaging said impeller tube to prevent rotational movement therebetween;

a stop mounted on said motor shaft and positioned to engage said coupler and to limit axial movement of said coupler on said motor shaft; and said coupler engaging said stop and being detachably secured to said impeller tube to hold said impeller tube in a predetermined axial position on said motor shaft.

13. A pump assembly according to claim 12 wherein said coupler threadably engages said impeller tube and causes said impeller tube to move axially on said motor shaft in response to relative rotation between said coupler and said impeller tube.

14. A pump assembly according to claim 12 wherein said coupler includes a plurality of fan blades extending radially outwardly therefrom.

15. A pump assembly according to claim 12 wherein said coupler includes a coupler flange and said impeller tube includes an impeller flange engaging said coupler flange, a clip detachably joining said first and second flanges together.

16. A pump assembly according to claim 12 wherein said motor shaft includes an annular groove therein; and said coupler includes a slot therein, said stop comprising a clip retentively engaging and fitted within both of said slot and said annular groove.

17. A method for assembling a pump including a motor having a motor shaft extending therefrom and terminating in a shaft end, a pump having a housing wall with an exterior side, an interior side, and a shaft opening extending therethrough, said method comprising:

placing an impeller on said interior side of said housing wall, said impeller having an impeller tube extending therefrom and terminating in an open hollow tube end;

extending said impeller tube through said shaft opening to a position wherein said impeller is on said interior side of said housing wall and said open hollow tube end is on said exterior side of said housing wall;

extending said motor shaft through a bore of a coupler;

attaching a stop to said motor shaft;

retentively engaging said coupler with said stop to limit axial movement of said coupler on said motor shaft toward said motor shaft end;

inserting said shaft end axially into said open hollow tube end of said impeller tube while at the same time preventing relative rotation between said motor shaft and said impeller tube;

attaching said coupler to said impeller tube with said coupler engaging said stop and being located on said exterior side of said housing wall.

18. A method according to claim 17 wherein said step of attaching said coupler to said impeller tube comprises threadably attaching said coupler to said impeller tube and rotating said coupler relative to said impeller tube so as to cause axial movement of said impeller tube on said motor shaft to a predetermined desired axial position on said shaft.

19. A method according to claim 17 wherein said impeller tube includes an annular clearance groove thereon, said method further comprising using said coupler to hold said impeller tube with said clearance groove in registered alignment within said shaft opening of said housing wall.

* * * * *